US010737825B2

(12) United States Patent
Tuszkiewicz et al.

(10) Patent No.: US 10,737,825 B2
(45) Date of Patent: Aug. 11, 2020

(54) CARTON AND METHOD OF CREATING THE CARTON

(71) Applicant: General Mills, Inc., Minneapolis, MN (US)

(72) Inventors: George A Tuszkiewicz, Plymouth, MN (US); Peter L Novotny, Brooklyn Park, MN (US); Jenna M Ronquillo, Woodbury, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 16/072,973

(22) PCT Filed: Feb. 17, 2016

(86) PCT No.: PCT/US2016/018247
§ 371 (c)(1),
(2) Date: Jul. 26, 2018

(87) PCT Pub. No.: WO2017/142527
PCT Pub. Date: Aug. 24, 2017

(65) Prior Publication Data

US 2019/0023446 A1 Jan. 24, 2019

(51) Int. Cl.
*B65D 5/32* (2006.01)

(52) U.S. Cl.
CPC ..... *B65D 5/323* (2013.01); *B65D 5/321* (2013.01); *B65D 5/324* (2013.01)

(58) Field of Classification Search
CPC ..... B65D 5/323; B65D 5/0015; B65D 5/324; B65D 2301/10
USPC ..... 229/120, 122.24, 919, 122.21, 122.32; 493/84, 906
See application file for complete search history.

(56) References Cited

U.S. PATENT DOCUMENTS

| | | | | |
|---|---|---|---|---|
| 3,099,379 | A * | 7/1963 | Stease | B65D 5/323 229/122.26 |
| 3,291,370 | A * | 12/1966 | Elias | B65D 5/0227 229/125.41 |
| 4,398,901 | A | 8/1983 | Campbell | |
| 5,893,513 | A | 4/1999 | Stone et al. | |
| 6,168,074 | B1 * | 1/2001 | Petriekis | B65D 5/323 229/122.24 |
| 6,352,199 | B1 | 3/2002 | Gardner | |
| 8,177,117 | B2 * | 5/2012 | Little | B65D 5/16 229/120.18 |
| 8,196,806 | B2 * | 6/2012 | Tao | B65D 5/324 229/122.26 |

(Continued)

FOREIGN PATENT DOCUMENTS

WO WO 2015/116049 8/2015

*Primary Examiner* — Christopher R Demeree
(74) *Attorney, Agent, or Firm* — Diedriks & Whitelaw, PLC; Gregory P. Kaihoi, Esq.

(57) ABSTRACT

A carton is formed by folding and interconnecting a plurality of body pieces to establish at least front and rear panels and opposing side panels which can be joined to establish the carton with an interior cavity for containing edible products. At least two of the front, rear and opposing side panels are interconnected by one or more bridge tabs so as to constitute a unitary, single one of the separate body pieces, thereby preventing the interconnected panels from skewing during assembly of the carton.

20 Claims, 8 Drawing Sheets

(56) References Cited

U.S. PATENT DOCUMENTS 8,323,165 B2 * 12/2012 Atoui ..... B31B 50/00
493/175

* cited by examiner

CARTON AND METHOD OF CREATING THE CARTON

FIELD OF THE INVENTION

The invention generally pertains to packaging products, such as food products, in cartons and, more specifically, to a carton made from multiple, separate pieces, with at least two of the pieces being interconnected by one or more bridge tabs.

BACKGROUND OF THE INVENTION

In connection with shipping various types of products, such as food products, from a manufacturer to a retail establishment, it is known to initially package the products in cartons. Although various materials could be used in making the cartons, the most common material employed is paperboard. In general, the paperboard is provided in the form of a blank which can be conveniently stored in a flat configuration or side seamed configuration but easily erected through a simple folding operation to establish an open-ended carton which can be filled and sealed, typically in an automated process. Multiple cartons are then typically arranged side-by-side in a corrugated box for shipping through designated distribution channels to the retail establishment, such as a grocery store, where the cartons in each shipping box can be unloaded and arranged on a display shelf for sale to consumers.

As indicated above, a known end load carton of this type is typically formed by folding a unitary blank. It is also possible to erect a carton by interconnecting separate carton panels. However, there are numerous drawbacks associated with employing separate carton panels. Most particularly, extreme care must be taken to prevent skewing of the panels during assembly. This problem is exacerbated if carton assembly is performed at high speeds with automated machinery. Given this and other problems, this type of carton construction and assembly is generally prohibitive. Still, it would be desirable to provide paperboard or other material cartons which can be made from a plurality of separate body pieces assembled with precision, particularly utilizing automated machinery.

SUMMARY OF THE INVENTION

The invention is directed to forming a carton from multiple, separate pieces which are subsequently bonded together, with at least one of the pieces including multiple carton panels interconnected by one or more bridge tabs. The inclusion of the bridge tabs assures proper alignment between the interconnected panels during overall assembly, particularly using automated high speed assembly and bonding equipment. More specifically, a carton constructed in accordance with the invention is formed from multiple body pieces, with at least two of the body pieces being interconnected by one or more bridge tabs. When the body pieces are assembled to form a carton, the bridge tab(s) prevents skewing of the interconnected pieces, thereby assuring greater assembly precision, even when such cartons are assembled at high speeds with automated equipment. In accordance with certain embodiments of the invention, face and back panels of the carton are interconnected by one or more bridge tabs, and additional side panels are provided to complete the carton by joining the face and back panels. In this construction, the bridge tab(s) can remain attached to the front and back panels, while either being exposed outside of a respective side panel or to the interior of the carton. Alternatively, the one or more bridge tabs can be removed in a latter assembly stage, with or without the aid of perforations. In other embodiments, the particular panels and the number of panels which are interconnected by the bridge tabs vary.

In accordance with another aspect, added strength of the resulting cartons is provided by making the pieces vary in at least one of fiber orientation, basis weight (caliper) and material construction, while the amount of fiber utilized, as compared to a conventional carton, is actually held constant or even reduced. That is, in certain embodiments, the body pieces are formed of paperboard or cardboard and a fiber orientation between various wall portions are established to be directionally different. Optionally, a caliper of the various wall portions can be varied. Overall, the carton exhibits enhanced compression strength which enables similarly configured ones of the cartons to be directly stacked for shipping purposes.

Additional objects, features and advantages of the invention will become more readily apparent from the following detailed description when taken in conjunction with the drawings wherein like reference numerals refer to corresponding parts in the several views.

DETAILED DESCRIPTION OF THE INVENTION

Figure 1:
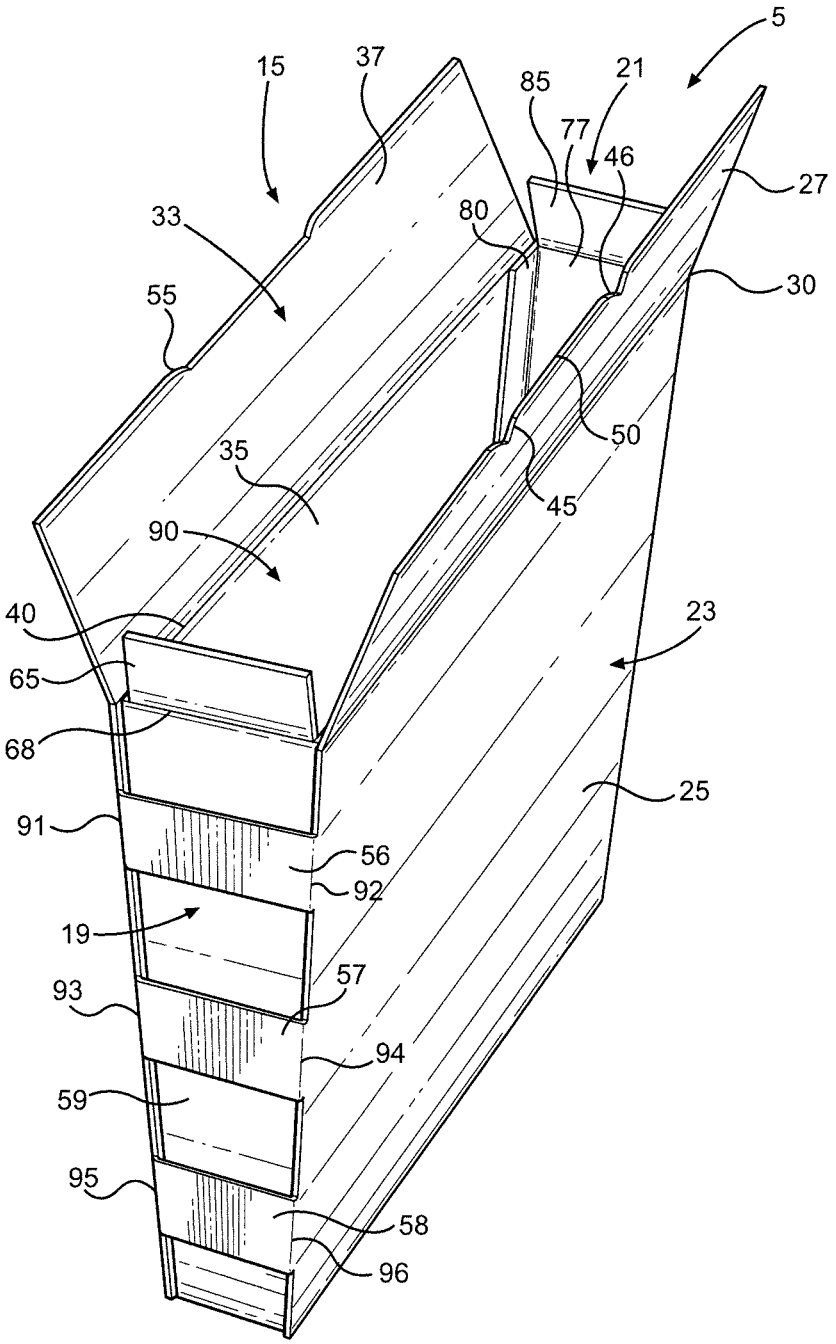
FIG. 1 is an upper perspective view of an open ended paperboard carton constructed from front and rear panels which are interconnected by various bridge tabs, and two side panels in accordance with an embodiment of the invention.

Detailed embodiments of the present invention are disclosed herein. In connection with this description, it should be noted that the use of certain terms, such as inside, outside, front, rear, top, bottom and the like, herein is for reference purposes only in describing exemplary forms of the invention as set forth below and illustrated in the drawings. Therefore, these terms should not be considered limiting as to the overall invention. Instead, it is to be understood that the disclosed embodiments are merely exemplary of the invention that may be embodied in various and alternative forms. The figures are not necessarily to scale, and some features may be exaggerated or minimized to show details of particular features or components.

In general, described below is the construction of cartons, such as food cartons formed from paperboard or cardboard, in accordance with the invention. It will be recognized that each embodiment is concerned with establishing a carton by interconnecting various body pieces, with at least one of the body pieces defining multiple panels which are interconnected by one or more bridging tabs that prevent skewing of the interconnected panels and assuring greater assembly precision. In accordance with another aspect of the invention, the different body pieces can vary in construction, particularly with respect to a caliper and/or a fiber orientation between various panel portions established by the individual body pieces, thereby enabling similarly configured ones of the cartons to be directly stacked for shipping purposes.

Figure 2:
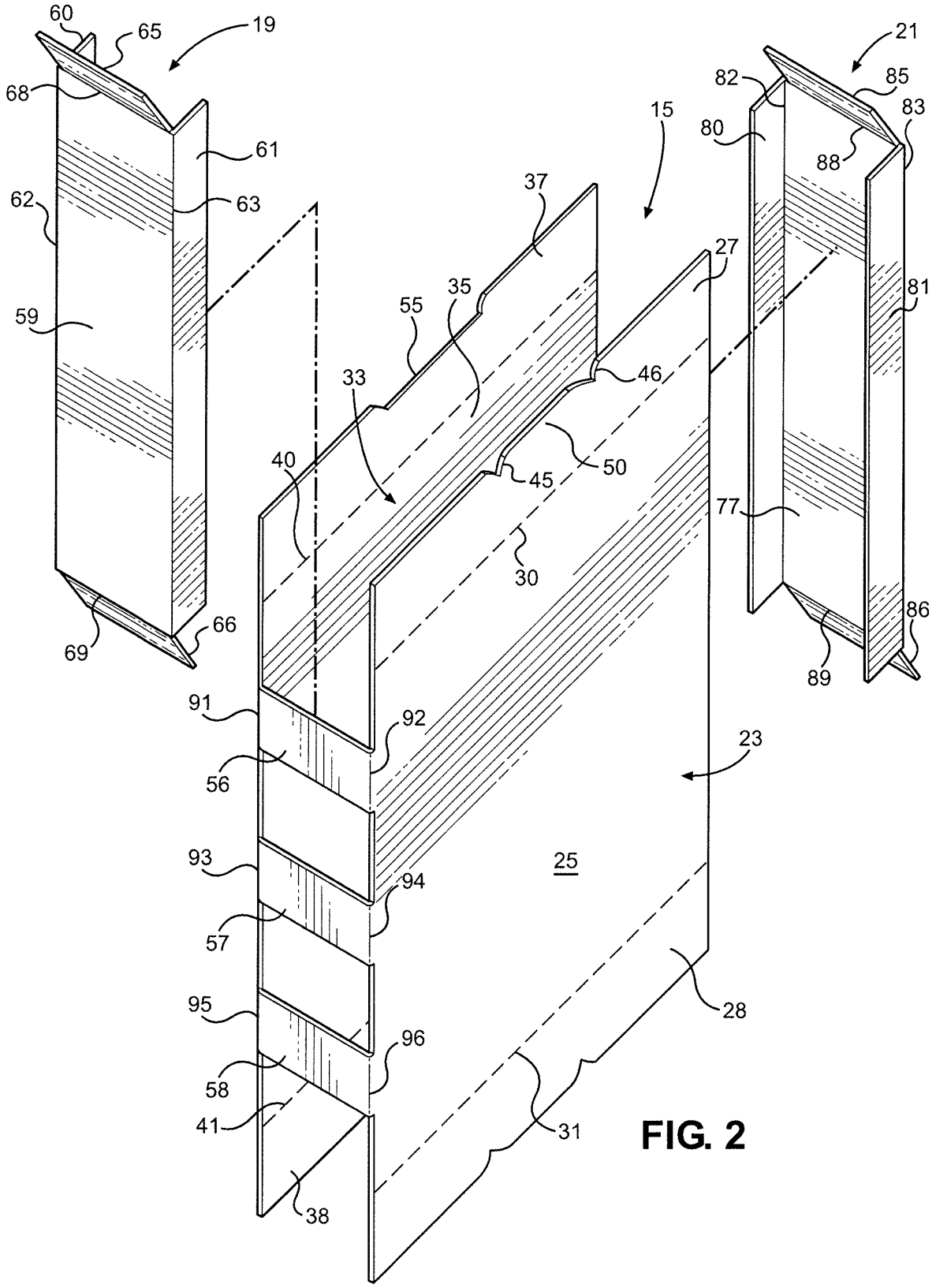
FIG. 2 is an exploded view of the body pieces of the carton of FIG. 1.

With initial reference to FIGS. 1 and 2, an open ended carton constructed in accordance with the present invention is generally indicated at 5. In accordance with this preferred embodiment, carton 5 is formed by folding and interconnecting three separate body pieces, including a main body piece 15, a first side piece 19 and a second side piece 21. More specifically, main body piece 15 includes a first main body piece 23 having a first main side or front panel 25, an upper flap 27 and a lower flap 28, with upper and lower flaps 27 and 28 being joined to front panel 25 along fold lines 30 and 31 respectively. In addition, main body piece 15 includes a second main body piece 33 having a second main side or rear panel 35, an upper flap 37 and a lower flap 38, with upper and lower flaps 37 and 38 being joined to rear panel 35 along fold lines 40 and 41 respectively. Overall, each of front and back panels 25 and 35 are shown to be substantially rectangular in shape, while spaced notches 45 and 46 are formed in a central tab 50 in upper flap 27 and a central recess 55 is provided in upper flap 37. Most important in connection with this embodiment of the invention is the inclusion of one or more bridge tabs interconnecting front panel 25 and rear panel 35. In the embodiment shown in these figures, three such bridge tabs 56-58 are shown interconnecting front and back panels 25 and 35 at spaced locations. With the inclusion of bridge tabs 56-58, front panel 25 and rear or back panel 35 combine to constitute a unitary, single one of the separate body pieces, i.e., main body piece 15.

As shown best in FIG. 2, first side piece 19 includes a side panel 59 from which extend, at spaced locations, elongated legs 60 and 61 along fold lines 62 and 63 respectively, as well as short legs 65 and 66 along fold lines 68 and 69. In the embodiment shown, second side piece 21 is symmetrically constructed to first side piece 19 and therefore includes a side panel 77, elongated legs 80 and 81, fold lines 82 and 83, short legs 85 and 86, and fold lines 88 and 89.

Figure 3:
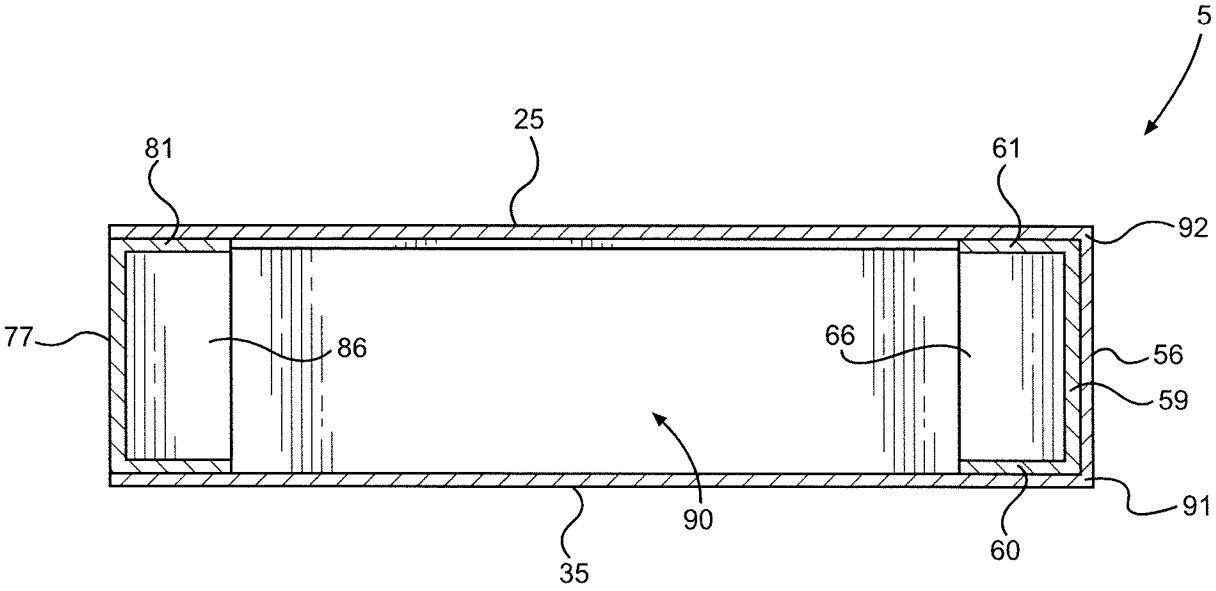
FIG. 3 is top cross-sectional view of the carton of FIG. 1.

In assembling or erecting carton 5 to the condition presented in FIGS. 1 and 3, front and rear panels 25 and 35 are first positioned as illustrated in FIG. 2 by folding front and rear panels 25 and 35 relative to bridge tabs 56-58 along fold lines 91-96. Elongated legs 60 and 61 of side panel 59 are folded along lines 62 and 63. Then, side panel 59 is inserted between front and rear panels 25 and 35, and then elongated leg 60 is attached, such a through the use of an adhesive and/or other bonding materials and methods (including ultrasonic welding), to rear panel 35 while elongated leg 61 of side panel 59 is attached to front panel 25. With this arrangement, bridge tabs 56-58 extend along and are overlapped by side panel 59 from inside of carton 5, while being exposed from the outside of carton 5. Elongated legs 80 and 81 are similarly folded along lines 82 and 83 and then side panel 77 is correspondingly attached to front and rear panels 25 and 35. In addition, short legs 66 and 86 are folded toward each other along lines 69 and 89 respectively, followed by lower flap 38 along line 41. Thereafter, lower flap 28 is folded along line 31 and adhered or otherwise secured to lower flap 38 to establish a bottom wall for carton 5.

At this point it should be recognized that, at least in this embodiment shown, front and rear panels 25 and 35 are the largest of the side walls of carton 5 in area, i.e., each panel 25, 35 establishes a face for carton 5 having an associated area which is generally in the order of at least three times the surface area of either of opposing side panels 59 and 77. For the particular type of carton shown, each of the side panels 59, 77 is also greater in area than a bottom wall established essentially by overlapping lower flaps 28 and 38. By way of example, panel 25 can constitute the face of a cereal or other carton and can be provided with suitable indicia reflecting the name, brand and the like of product contained within an interior cavity 90 (see FIG. 1) defined within carton 5 for products to be sold to a consumer, such as edible cereal food products.

With this arrangement, much like a conventional food carton which is formed by folding a single blank, the top of carton 5 can be selectively closed, after being initially opened, by slipping tab 50 of upper flap 27 under lower flap 37 in the region of central recess 55. However, unlike conventional food cartons, body pieces 15, 19 and 21 can be folioed differently. For instance, body pieces 19 and 21 can be constructed different from body piece 15. More specifically, in accordance with preferred aspects of the invention, carton 5 is made of paperboard or cardboard, with different body pieces varying in at least one of basis weight, fiber orientation and material construction to provide carton 5 with increased strength but with a reduction in the amount of fiber utilized, as compared to a conventional carton. Still, most important in accordance with the invention is that the body pieces form the requisite front, rear and side panels, with at least two of the panels being interconnected by bridge tabs. With this arrangement, there is no potential for a skewing problem between the interconnected panels during assembly of carton 5 and the overall carton can be made with greater precision, even utilizing automated machinery operating at high production speeds.

In addition to the assembly advantages based on the inclusion of the bridge tabs, with the above separate piece construction, carton 5 to be specifically designed to withstand significant vertical loading without being crushed or buckling, thereby enabling multiple cartons 5 to be vertically stacked and withstand certain vertical loads exerted thereon, even when shipped. Initially, it should be recognized that the vertical load capability of carton 5 is enhanced to a certain degree in accordance with the invention, as compared to a conventional carton made from folding a single blank, based on the inclusion of legs 60, 61, 80 and 81, along with the associated bonding material, at the vertical corners of carton 5. Therefore, the multi-piece construction of carton 5 contributes to the goals of the invention. However, other structural parameters can also be altered to enable the objects of the invention to be achieved. In particular, the basis weight or caliper of the paperboard or cardboard material of body pieces 19 and 21 can be made greater than the caliper of body piece 15. This feature can be achieved by reducing the basis weight of body piece 15, increasing the basis weight of body pieces 19 and 21, or both. In addition, the fiber orientation of body pieces 19 and 21, in particular side walls 59 and 77, can be made different than body piece 15, particularly front and rear panels 25 and 35. For instance, the fibers of front and rear panels 25 and 35 can be arranged to run predominantly horizontally (i.e., directionally between opposing side walls 59 and 77), while the fibers of opposing side walls 59 and 77 predominantly run vertically (i.e., directionally between the top and bottom walls). Obviously, paperboard or cardboard will generally have mixed fiber orientations. However, in the context of the disclosure, it is the overall majority of the fiber orientation that is controlled. It should also be noted that, although the entire carton 5 can be formed of a single material, mixed types of materials can be employed, such as non-recycled material for body pieces 19 and 21 versus recycled materials for body piece 15, in general a variation in material composition, such as different grades of board. Overall, the top-to-bottom and side-to-side compression strength can be enhanced by increasing the amount of basis weight of fiber in the areas of the greatest mechanical stresses.

Figure 4:
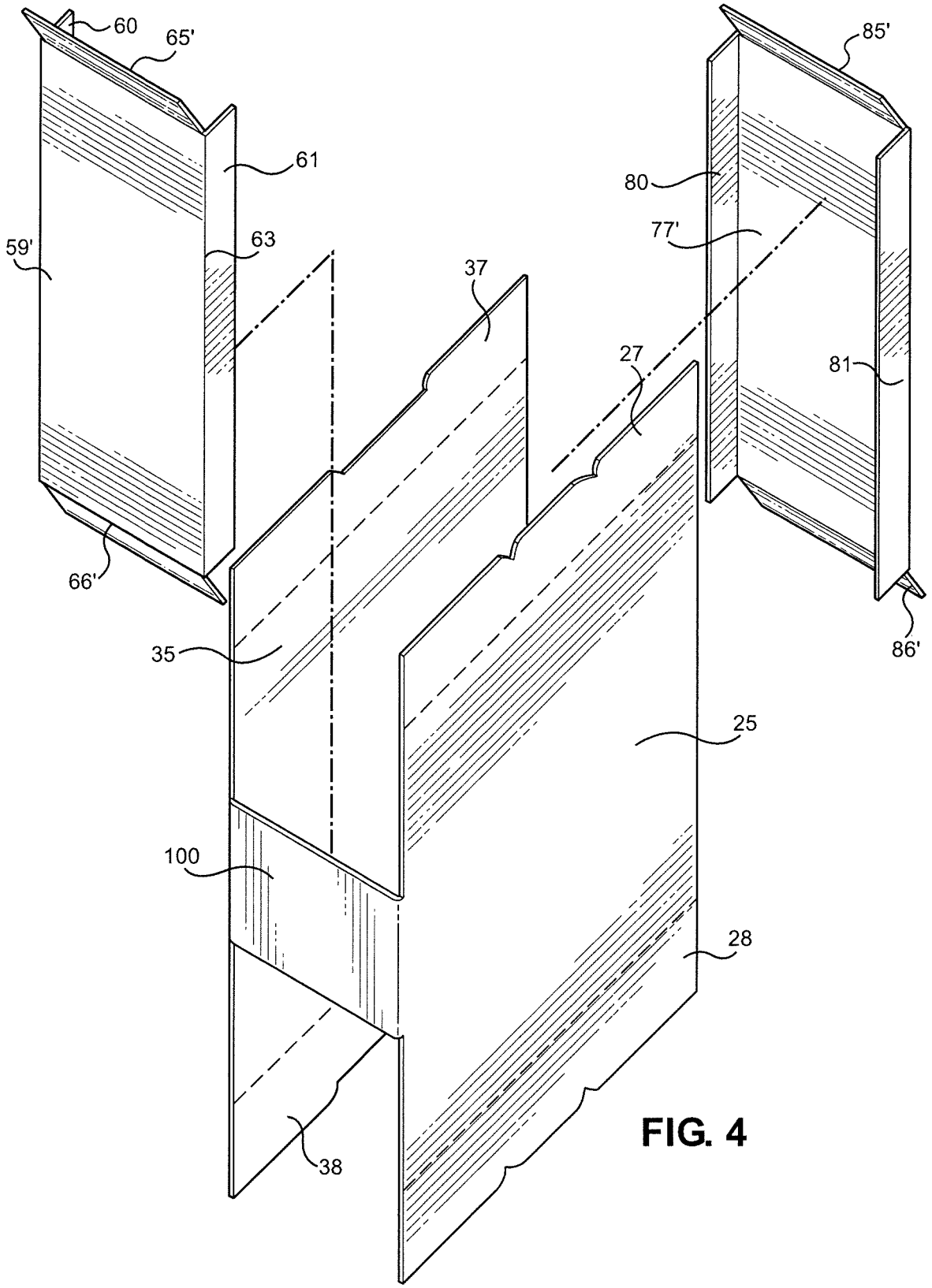
FIG. 4 is an exploded view of another carton embodiment.
Figure 5:
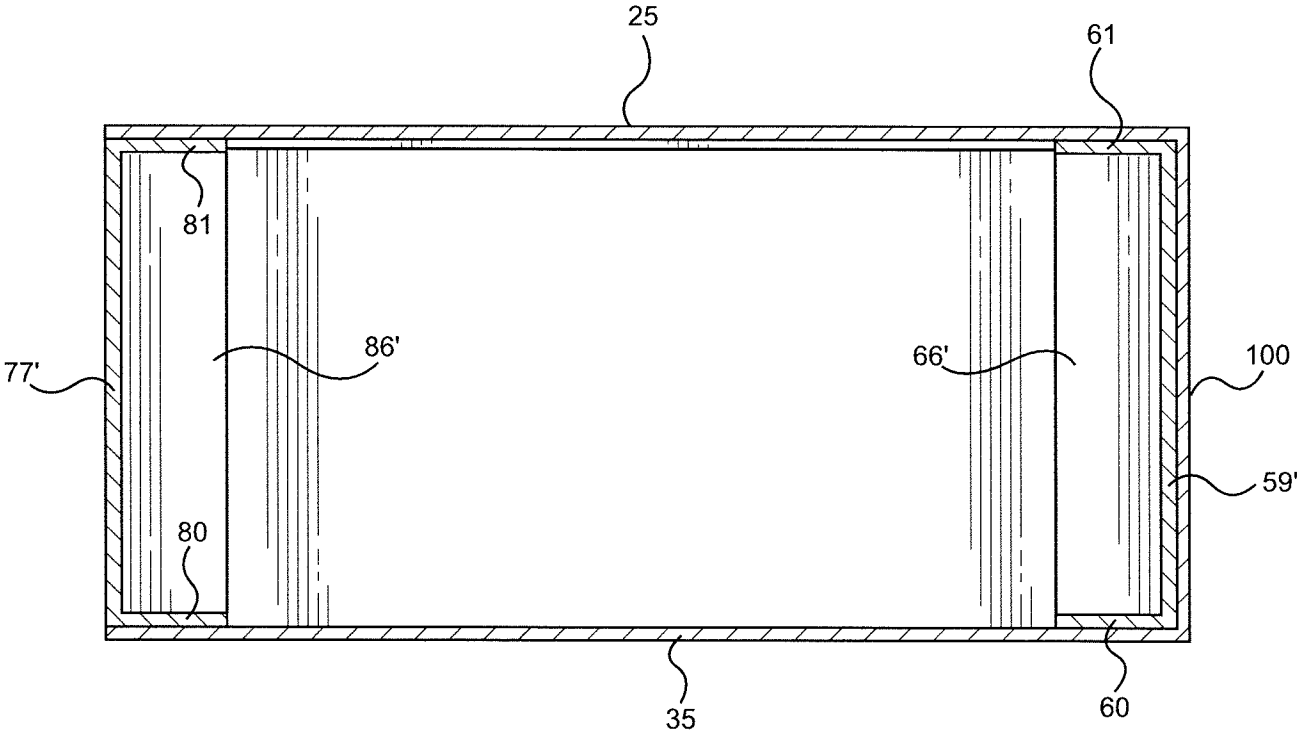
FIG. 5 is cross-sectional view of the carton of FIG. 4 assembled.

Prior to discussing additional details and advantages of the invention, it should be recognized that the various body pieces can be varied in construction, size and shape, while the location and construction of the bridge tab(s) can also vary significantly without departing from the invention. For instance, in the embodiment of FIGS. 1-3, three spaced bridge tabs 56-58 are provided which are sized to have a longitudinal dimension approximately equal to a lateral or width dimension of each of side panels 59 and 77, while bridge tabs 56 and 58 are shown spaced from flaps 65 and 66 respectively. In addition, bridge tabs 56-58 are shown to be exposed from the outside of carton 5. However, this arrangement could be readily altered. For instance, only one or more bridge tabs could be provided, the bridge tab(s) could be vertically repositioned and/or sized differently, and the bridge tab(s) could be exposed inside or outside of carton 5. To this end, FIGS. 4 and 5 show a variant wherein only a single, wider and longer bridge tab 100 is employed to interconnect front and rear panels 25 and 35. Correspondingly, side panels 59' and 77' are wider, along with flaps 65', 66', 85' and 86'.

Figure 6:
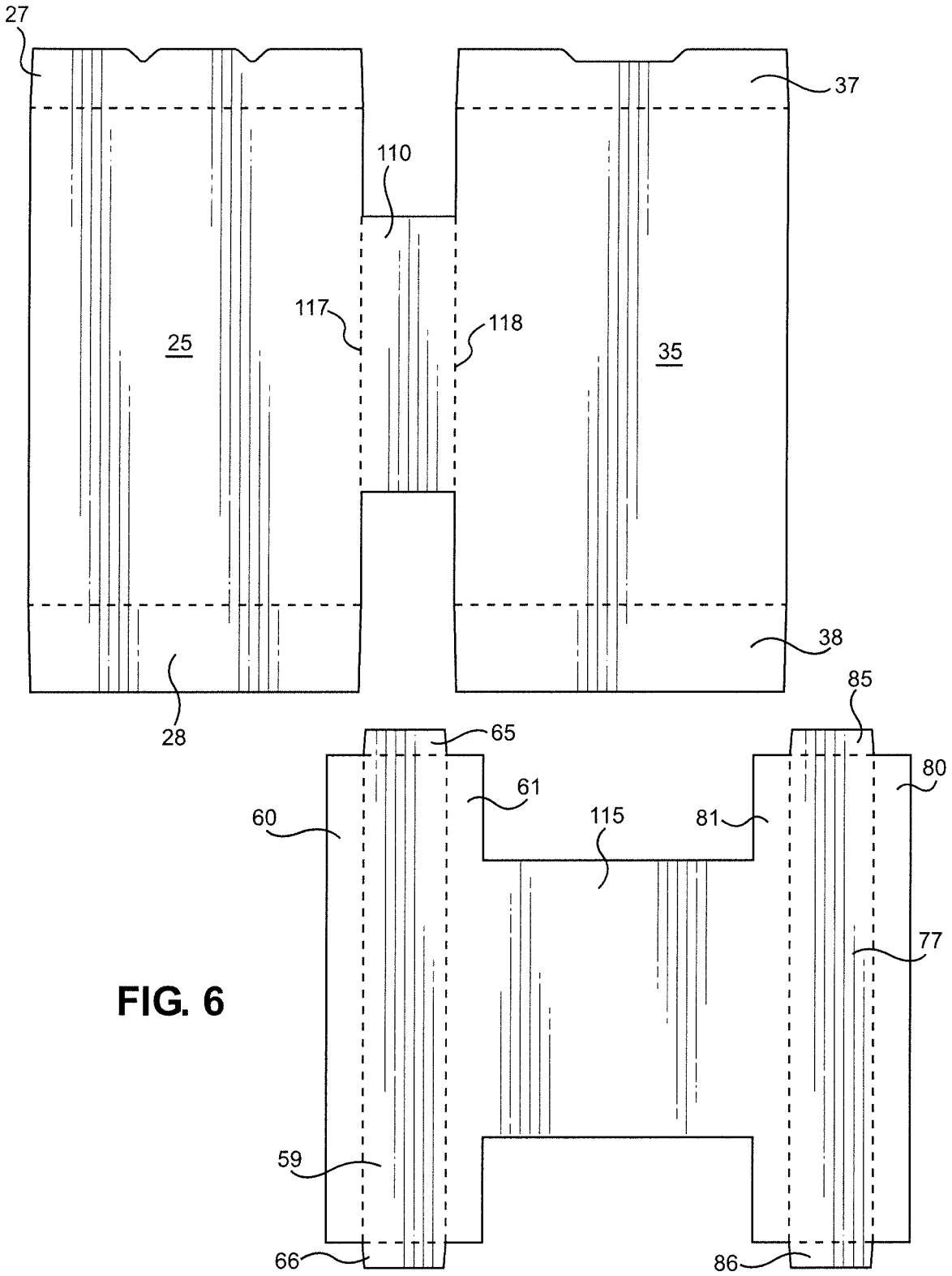
FIG. 6 is an exploded view of the body pieces for a carton wherein panel pairs are interconnected by bridge tabs.
Figure 7:
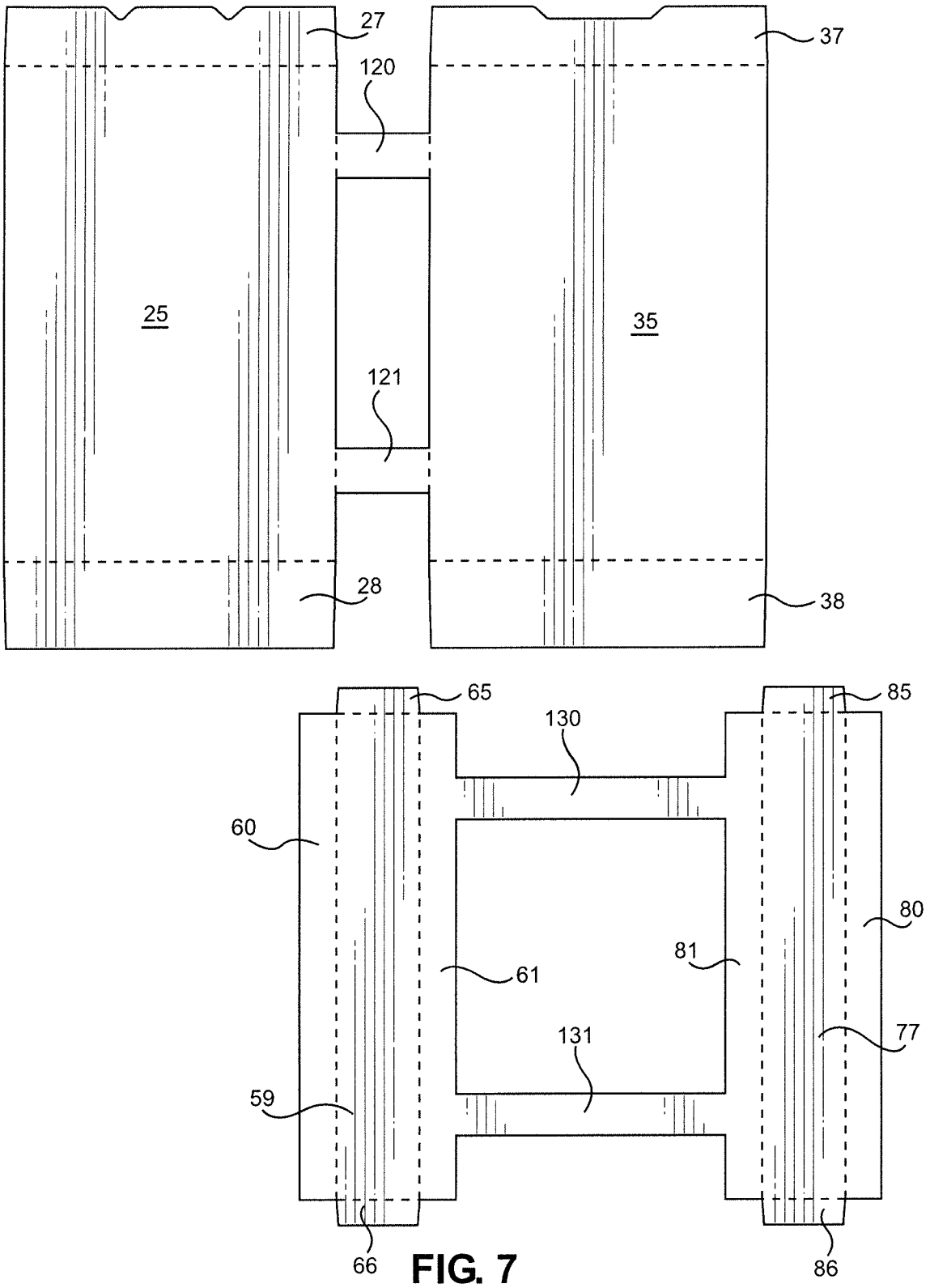
FIG. 7 is an exploded view of the body pieces for a carton wherein pairs of panels are interconnected by bridge tabs in accordance with another embodiment.
Figure 8:
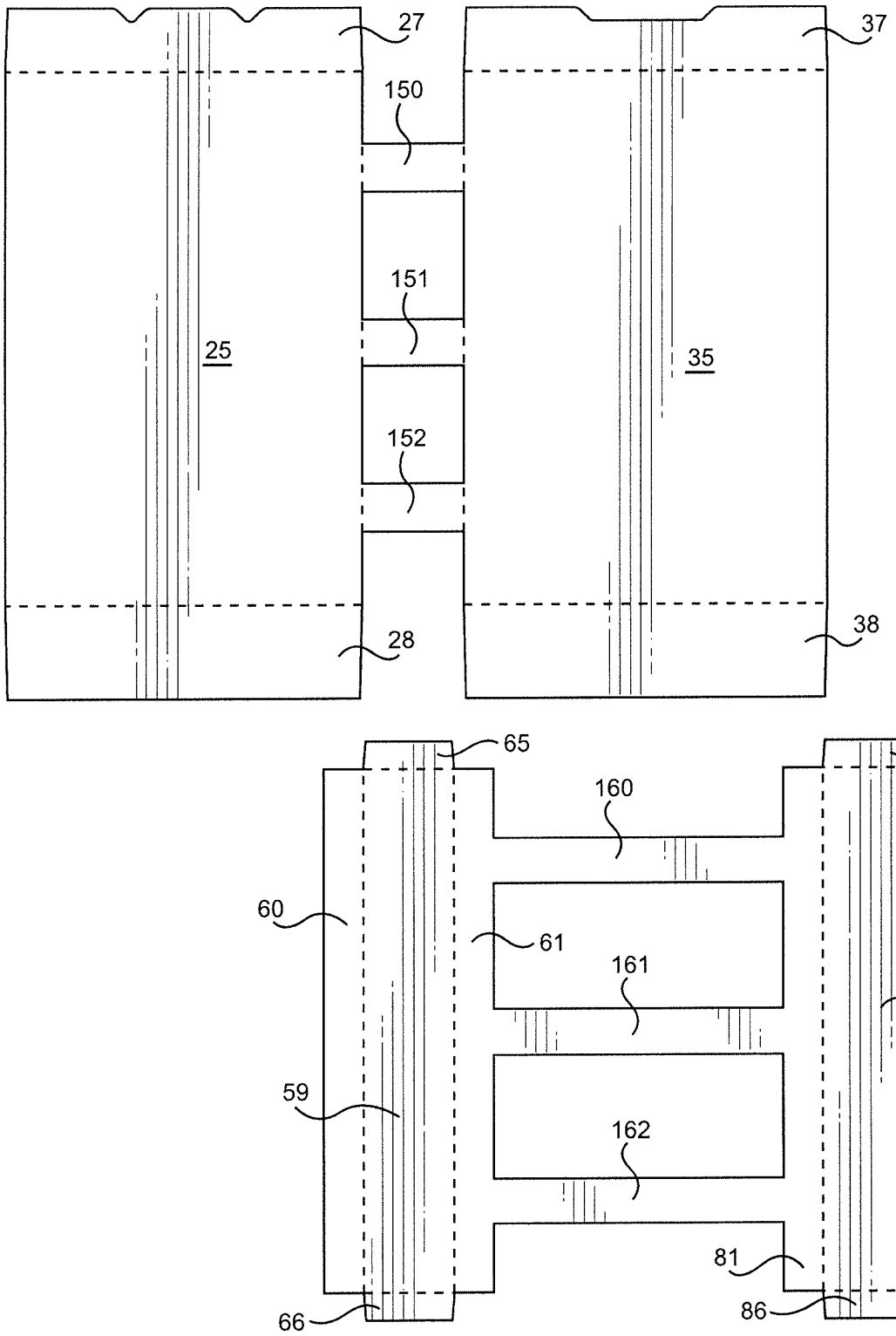
FIG. 8 is an exploded view of the body pieces for a carton wherein pairs of panels are interconnected by bridge tabs in accordance with a further embodiment.

FIGS. 6-8 illustrate still further variations. For instance, in each of these figures, multiple ones of the carton panels are interconnected by one or more bridge tabs. For instance, FIG. 6 shows front and rear panels 25 and 35 interconnected by a single bridge tab 110 so that front and rear panels 25 and 35 constitute a unitary, single one of the separate body pieces of carton 5, while side panels 59 and 77 are themselves interconnected by another bridge tab 115. With this arrangement, just as bridge tab 110 has a width dimension approximately equal to the width of each of side panels 59 and 77, bridge tab 115 has a width dimension approximately equal to the width of each of front and rear panels 25 and 35. With this carton construction, one of bridge tabs 110 and 115 will be exposed from outside of the carton, while the other one of bridge tabs 110 and 115 will be exposed to an interior of the carton. That is, either bridge tab 110 will be overlapped by one of side panels 59 and 77, or bridge tab 115 will be overlapped by one of front and rear panels 25 and 35. At this point, it should be noted that, at the moment of assembly, and also after assembly of a carton in accordance with any of the embodiments of the invention, the one or more bridge tabs can be removed. This can be done by cutting, tearing or the like the bridge tabs from the panels or, in a more preferred arrangement, the bridge tabs can be interconnected to the corresponding panels through perforated lines of connection (such as represented at 117 and 118 in FIG. 6 for bridge tab 110 by way of example), thereby enabling one or more of the bridge tabs to be readily removed if desired. In addition, after assembly, the bridge tabs can serve other functions, such as being used to provide a handle for the carton. FIGS. 7 and 8 shows direct variations of the embodiment of FIG. 6 wherein only the number of bridge tabs are varied, i.e., the embodiment of FIG. 7 employs two spaced bridge tabs 120 and 121 to interconnect front and rear panels 25 and 35, as well as two additional, spaced bridge tabs 130 and 131 to interconnect side panels 59 and 77; and the embodiment of FIG. 8 employs three spaced bridge tabs 150-152 to interconnect front and rear panels 25 and 35, as well as three additional, spaced bridge tabs 160-162 to interconnect side panels 59 and 77.

Regardless of these potential variations, the caliper, materials and/or fiber orientation variations discussed above can be equally employed such that the compression strengths associated with the cartons or boxes constructed in accordance with the invention can be made significantly greater than the compression strength of a conventional carton made from a single blank, even when the basis weight of the cartons made in accordance with the invention is held constant or reduced. Therefore, the cartons of the invention can be made to withstand increased vertical loading, but the same can be achieved with fiber reductions and, correspondingly, savings in material costs.

As indicated above, a feature of the present invention is to form carton from a plurality of body pieces to enable enhancements in strength and construction. However, it is the provision of the one or more bridge tabs which advantageously avoids potential skewing between the interconnected panels and provides the ability to manufacture the cartons with automated machinery while assuring precision construction. Although disclosed with reference to preferred embodiments of the invention, is should be readily apparent that various changes and modifications can be made to the invention without departing from the spirit thereof.

The invention claimed is:

1. A carton comprising a plurality of separate body pieces establishing a front panel, a rear panel, opposing side panels, a bottom wall and a top wall, wherein at least one of the plurality of separate body pieces is a unitary piece comprising at least two of the front, rear and opposing side panels interconnected by one or more bridge tabs, each of the at least two of the front, rear and opposing side panels interconnected by the one or more bridge tabs is folded relative to the one or more bridge tabs along one or more respective fold lines, and each of the one or more respective fold lines has a length that is smaller than the full length of each of the at least two of the front, rear and opposing side panels interconnected by the one or more bridge tabs.

2. The carton of claim 1, wherein the one or more bridge tabs constitutes multiple, spaced bridge tabs.

3. The carton of claim 2, wherein the multiple, spaced bridge tabs includes at least three bridge tabs.

4. The carton of claim 1 wherein, upon assembly, the one or more bridge tabs are overlapped by another one of the front, rear and opposing side panels.

5. The carton of claim 4, wherein the one or more bridge tabs are exposed from outside of the carton.

6. The carton of claim 4, wherein the one or more bridge tabs interconnect the front and rear panels, with the one or more bridge tabs extending along one of the opposing side panels.

7. The carton of claim 1, wherein two other ones of the front, rear and opposing side panels are interconnected by one or more additional bridge tabs so as to constitute a second unitary one of the separate body pieces.

8. The carton of claim 1, wherein each of the one or more bridge tabs has a length substantially equal to a width of one of the side panels.

9. The carton of claim 1, wherein the one or more respective fold lines are perforated connections.

10. The carton of claim 1, wherein the plurality of separate body pieces are interconnected to form the carton with an interior cavity containing at least one edible cereal product to be sold to a consumer.

11. The carton of claim 10, wherein:

a) each of the front, back and side panels is formed of paperboard; and b) at least one of a caliper or a fiber direction between at least two of the separate body pieces is distinct.

12. A carton comprising a plurality of separate body pieces establishing a front panel, a rear panel, opposing side panels, a bottom wall and a top wall, wherein at least two of the front, rear and opposing side panels are interconnected by one or more bridge tabs so as to constitute a unitary, single one of the separate body pieces, wherein each of the one or more bridge tabs has a length substantially equal to a width of one of the front and back panels.

13. A method of creating a carton comprising:

forming a plurality of separate body pieces establishing a front panel, a rear panel, opposing side panels, a bottom wall and a top wall, wherein at least one of the plurality of separate body pieces is a unitary piece comprising at least two of the front, rear and opposing side panels are interconnected by one or more bridge tabs;

folding the each of the at least two of the front, rear and opposing side panels interconnected by the one or more bridge tabs relative to the one or more bridge tabs along one or more respective fold lines such that the at the least two of the front, rear and opposing side panels are spaced by the one or more bridge tabs, wherein each of the one or more respective fold lines has a length that is smaller than the full length of each of the at least two of the front, rear and opposing side panels interconnected by the one or more bridge tabs; and interconnecting the plurality of separate body pieces, with the front and rear panels, as well as the opposing side panels, being spaced to define an interior cavity of the carton.

14. The method of claim 13, wherein the one or more bridge tabs includes two or more spaced bridge tabs.

15. The method of claim 13, wherein, upon interconnecting the plurality of separate body pieces, the one or more bridge tabs are overlapped by another one of the front, rear and opposing side panels.

16. The method of claim 15, wherein, upon interconnecting the plurality of separate body pieces, the one or more bridge tabs are exposed from outside of the carton.

17. The method of claim 15, wherein the one or more bridge tabs interconnect the front and rear panels, with the one or more bridge tabs extending along one of the opposing side panels.

18. The method of claim 13, wherein two other ones of the front, rear and opposing side panels are interconnected by one or more additional bridge tabs so as to constitute a second unitary one of the separate body pieces.

19. The method of claim 13, wherein the one or more respective fold lines are perforated connections, said method further comprising, upon erecting the carton, the one or more bridge tabs are removed along the perforated connections.

20. The method of claim 13, further comprising:

a) forming each of the front, back and side panels of paperboard; and b) assuring that at least one of a caliper or a fiber direction between at least two of the separate body pieces is distinct.

* * * * *